US010106908B1

(12) United States Patent
Rokicki

(10) Patent No.: US 10,106,908 B1
(45) Date of Patent: Oct. 23, 2018

(54) NITINOL FATIGUE RESISTANCE USING ELECTROPOLISHING, MAGNETOELECTROPOLISHING, ANODIZING AND MAGNETOANODIZING OR COMBINATIONS THEREOF UNDER OXYGEN EVOLUTION REGIME

(71) Applicant: Ryszard Rokicki, Emmaus, PA (US)

(72) Inventor: Ryszard Rokicki, Emmaus, PA (US)

( * ) Notice: Subject to any disclaimer, the term of this patent is extended or adjusted under 35 U.S.C. 154(b) by 8 days.

(21) Appl. No.: 15/483,201

(22) Filed: Apr. 10, 2017

(51) Int. Cl.

| | |
|---|---|
| ***C25D 11/26*** | (2006.01) |
| ***C25D 11/02*** | (2006.01) |
| ***C25F 3/16*** | (2006.01) |
| ***C25D 21/12*** | (2006.01) |

(52) U.S. Cl.
CPC ..... *C25F 3/16* (2013.01); *C25D 11/02* (2013.01); *C25D 11/26* (2013.01); *C25D 21/12* (2013.01)

(58) Field of Classification Search
CPC ..... C25D 11/26
USPC ..... 205/89
See application file for complete search history.

(56) References Cited

U.S. PATENT DOCUMENTS

| | | | | |
|---|---|---|---|---|
| 7,632,390 | B2 | 12/2009 | Rokicki | |
| 8,377,237 | B2 | 2/2013 | Rokicki | |
| 9,017,489 | B2 * | 4/2015 | Rokicki | A61B 17/12113 148/402 |
| 2002/0092583 | A1 * | 7/2002 | Pelton | C22F 1/006 148/243 |
| 2005/0060021 | A1 * | 3/2005 | O'Brien | A61F 2/82 623/1.15 |

OTHER PUBLICATIONS

High Compressive Pre-strains Reduce the Bending Fatigue Life of Nitinol Wire, Gupta, et al., Journal of the Mechanical Behavior of Biomedical Materials 44 (2015) 96-108.
Towards a Better Corrosion Resistance and Biocompatability Improvement of Nitinol Medical Devices, Rokicki, et al., Journal of Materials Engineering and Performance (On-line Publication Feb. 18, 2015).
Highlights of Magnetoelectropolishing, Hryniewicz, et al., Frontiers in Material—Corrosion Research, vol. 1, Article 3, May 2014.
Magnetic Fields for Electropolishing Improvement: Materials and Systems, Hryniewicz, et al., International Letters of Chemistry, Physics and Astronomy 4 (2014) 98-108.
Magnetoelectropolishing: A New Trend in Surface Finishing, Rokosz, et al., Metal 2013 Conference, May 15-17, 2013, Brno, Czech Republic, EU.
Modifying Metallic Implants with Magnetoelectropolishing, Rokicki, et al., Medical Device and Diagnostic Industry News, Surface Treatment Services, Jan. 2008.
Metal Surface Modification by Magnetoelectropolishing, Hryniewicz, et al., Metal 2007 Conference, May 22-24, 2007, Hradec nad Moracici, Czech Republic, EU.
Magnetoelectropolishing Titanium Biomaterial, Hryniewicz, et al., Biomaterials Science and Engineering, Chap. 11, InTech, Sep. 2011.

* cited by examiner

*Primary Examiner* — Brian W Cohen
(74) *Attorney, Agent, or Firm* — Sanford J. Piltch

(57) ABSTRACT

The method for improvement of Nitinol fatigue fracture resistance may be accomplished by electropolishing or magnetoelectropolishing under oxygen evolution regime, and by anodizing or magnetoanodizing the intermetallic compound. All four processes are performed under an oxygen evolution regime and by these processes the outermost and subsequent underlying oxide layers are enriched with oxygen which saturates, fills oxygen vacancies and bridges surface oxide lattice defects making the passive oxide layer more stoichiometric and homogenous, elastic and, as a result of the oxygen enrichment, more fatigue fracture resistant.

3 Claims, No Drawings

NITINOL FATIGUE RESISTANCE USING ELECTROPOLISHING, MAGNETOELECTROPOLISHING, ANODIZING AND MAGNETOANODIZING OR COMBINATIONS THEREOF UNDER OXYGEN EVOLUTION REGIME

BACKGROUND OF THE INVENTION

The electropolishing process is almost a 100 year old electrochemical process applied to metals, metals alloys and intermetallic compounds for the purposes of smoothing the surface by minimizing macro and micro roughness, to make the work-piece surface shiny and reflective, to remove the stressed and deformed cracked layer (Beilby layer), to improve corrosion resistance, and in the case of metallic (human body) implants make them more bio- and hemocompatible. The electropolishing process mainly uses direct current (DC), the exception to this regimen is the platinum metal group, which is electropolished by using alternating current (AC).

The electropolishing and magnetoelectropolishing processes can be performed under two different oxygen regimes, namely; below and under oxygen evolution. The optimum current density for electropolishing as well magnetoelectropolishing processes have to be determined experimentally. Voltage-current curves have to be plotted and the plateau current density established. In most cases the best results are obtained when the potential is adjusted to a value just below the oxygen evolution potential. The best example of this kind of electropolishing is electropolishing of niobium cavities for a superconducting installation where surface smoothness is the main importance. However, many exceptions to the above rule are reported and occasionally the best polishing is obtained outside the current density plateau. For many metals, alloys and intermetallic compounds a second range of potentials and current densities corresponding to good polishing exists at values beyond the plateau, i.e., under the conditions of oxygen evolution.

Anodizing is an electrolytic process that creates a homogeneous anodic oxide layer on the surface of some metals, alloys and intermetallic compounds in order to improve corrosion and wear resistance and to achieve demanded tribological properties, etc. Magnetoanodizing is the anodizing process performed in an externally imposed constant magnetic field. In connection with the present invention, both of these processes are to be carried out under an oxygen evolution regime.

Due to its unique mechanical properties of pseudoelasticity, shape memory and good corrosion resistance Nitinol has found a permanent place as an advanced functional biomedical material. Nitinol is a compound consisting essentially of equal parts of Nickel and Titanium, represented as NiTi. Nitinol is used in the production of implantable medical devices, e.g., stents, heart valve frames, IVC filters, septal occluders, as well as medical and dental instruments, e.g., arthroscopic instruments, blood clot stent retrievers, guide wires, endodontic rotary files, etc. The implantable medical devices, as well as the medical instruments, in many cases undergo very severe bending, twisting, and cyclic stretching-contracting conditions during implantation and continued or continuing use.

Another advantage of Nitinol as an implantable material is its resistance to corrosion due to the presence of titanium oxide, which is the predominant compound residing in the passive film that spontaneously covers Nitinol on exposure to the ambient atmosphere. In order to improve corrosion resistance of the passive film layer, as well as removing other contaminants, smoothing the surface, and improving fatigue resistance, the material is subjected to electropolishing as a finishing step prior to sterilization.

Although titanium oxide is the dominant component in the passive film layer, it is not the only such component. An undesirable component of the passive film layer on substantially all electropolished Nitinol devices is Nickel. The amounts of Nickel vary depending upon electropolishing protocol used in the final step of the production of Nitinol medical devices. The sole presently available electrochemical process for substantially eliminating and removing Nickel in any form from the surface of Nitinol, resulting in the creation of pure titanium oxide on the Nitinol surface, is the magnetoelectropolishing process.

Generally, Nitinol possesses all of the attributes of a very good metallic biomaterial, but it is not totally without drawbacks. The primary drawback is the unavoidable intermetallic inclusions in Nitinol. Carbides [TiC], oxides [$Ti_4Ni_2O_x$, $TiO_2$] and intermetallic precipitates [$Ni_4Ti_3$, $Ni_3Ti$] are contained within the inclusions. Inclusions are randomly distributed throughout the entire Nitinol alloy material with their concentrations depending upon the melting procedure and purity of each component of the compound during production forming of the alloy material. Consequently, some of the inclusions will reside on the surface of the Nitinol material. Any inclusion formations in Nitinol are unwelcome, but inclusions appearing on Nitinol surfaces are particularly troublesome, not only because they are major crack initiation points along with internal inclusion sites, but also corrosion initiation sites. All bodily fluids, including blood, contain chlorides which are very corrosive to all metallic implantable materials including Nitinol. The corrosion mechanism associated with Nitinol having surface inclusions immersed in bodily fluids depends on the type of inclusion, but is intrinsically connected to an affinity of chloride ions to Nickel.

In the case of Titanium Carbide [TiC] or Titanium Oxide [$TiO_2$], chloride anions will react with the abundant Nickel content of Nitinol created by the drainage of Titanium from the matrix which surrounds the inclusion sites during the process of formation. The Nickel bearing inclusions become the source of free Nickel that will undergo dissolution in the chloride containing bodily fluid. Nickel, which is both an allergen and a carcinogen, will be released into the surrounding environment and into bodily tissues surrounding the Nitinol implantable device creating inflammatory and hypersensitivity reactions. For example, in the case of vascular stents made from Nitinol, the leached Nickel anions could lead to restenosis which diminishes stent patency. Another example of a product made from Nitinol is an implantable permanent birth control or sterilization device for women that is inserted into and across the fallopian tubes; one such device named Essure® is manufactured by Bayer®. The insertable device consists of two metal coils, one of which is made of Nitinol. In many reported cases the Nitinol coil has fractured and become embedded in or perforates the uterus, and/or migrates to other organs. In addition, nickel ions, which are released from the inclusions or from the nickel enriched matrix adjacent to the inclusions, trigger havoc in women's bodies prone to nickel allergies resulting in excessive menstrual bleeding, skin rashes, hair loss, headaches, including migraine headaches, and many more auto-immune disorders. Simultaneously, the dissolving Nickel from around inclusion sites and from the inclusions themselves will weaken the mechanical integrity of the stent or nitinol coil of the permanently implanted birth control device which will consequently lead to ultimate fracture.

Another drawback in using Nitinol is fatigue fracture. The fracture of Nitinol is a crack initiation and propagation phenomenon. This means that the existence of a crack is the point of no return giving rise to fatigue fracture. Taking under consideration the small diameters and cross sections of medical devices and tools, the second phase of crack propagation, however interesting from the material behavior point, is totally irrelevant from the practical one. The main source of crack initiation is surface intermetallic inclusions, which accounts for nearly all cases of Nitinol fracture. According to research undertaken by the U.S. Food and Drug Administration, Nitinol fatigue fractures are initiated from surface inclusions in nearly all cases and micro-cracks caused by cold working stresses, heat effected zones created by EMC or laser cutting.

One method which to some degree is capable of removing these imperfections from the surfaces of Nitinol is the electropolishing process, which by dissolution action is able to smooth the surface and by this smoothing eliminates micro-cracks and some of the minute surface intermetallic inclusions. Almost all Nitinol electropolishing processes are proprietary, but it is well-known that all of the processes are performed below the oxygen evolution regime and in the best cases they are able to improve fatigue life of Nitinol within a range of only ¼ to ½ fold. Those proprietary processes performed below the oxygen evolution regime employ three main groups of electrolytes: 1) methyl alcohol—sulfuric acid mixture; 2) perchloric—acetic acid mixture; 3) electrolytes containing citric acid. In order to achieve a higher fatigue life for surface inclusions-free Nitinol medical implantable devices and instruments the electropolishing process, as well as the magnetoelectropolishing process, has to be carried out under an oxygen evolution regime. By applying these processes the fatigue resistance can be elevated five-fold.

During electropolishing and magnetoelectropolishing of Nitinol under an oxygen evolution regime, in addition to electrolytic smoothing and reduction of nickel content in the passive protective layer, the Nitinol surface outermost oxide layer and consecutive deeper under layers are enriched in oxygen without any significant thickness changes. These additional oxygen ions are incorporated into the profile of the passive layer and are responsible for bridging and saturating the oxide lattice defects making the passive film more stoichiometric and homogeneous. The more perfect homogeneous oxide with lower lattice defects consequently improves fatigue resistance of Nitinol medical implantable devices and instruments by improved elasticity of titanium oxide crystals covering the surface, which slows the crack initiation phenomenon. It should be mentioned that electrolytically introduced oxygen into the passive layer does not enrich the metal-oxide interface in metallic nickel and its compound as thermal oxidation processes do and by this process eliminates another possible source of crack initiation.

The passive film formation during electropolishing under an oxygen evolution regime and anodizing can be explained by the Cabrera & Mott theory. According to high field mechanism for oxide film formation and growth theory the main prerequisite is the absorption of oxygen on a metal surface which creates an oxide monolayer. The next step is electron tunneling from the metal to the monolayer of adsorbed oxygen which by adding electrons became an electron trap on the outer surface of the oxide. As the number of electron traps increases the potential drop across the film grows. The drop in potential creates the electric field across the passive film which lowers the activation energy necessary for further transport of ions through the passive film.

The oxide on the Nitinol which is composed predominantly of titanium dioxide [$TiO_2$] is classified as an N-type semiconductor which means that anion transport thought the film is the dominate way of film growth and is due to oxygen ion movement toward the bulk of the Nitinol intermetallic compound. The thickening of the oxide film increases the activation energy necessary for further transport of oxygen ions and limits further passive film formation. The only way for further growth of the passive film at this point is to increase the potential drop across the film which simultaneously increases the electric field.

When the electropolishing and anodizing under an oxygen evolution regime are carried out in a magnetic field, i.e., magnetoelectropolishing and magnetoanodizing, the properties of oxygen and its behavior in the magnetic field are the critical factors. Oxygen is a paramagnetic element with two unpaired electrons that are attracted and aligned by a magnetic field. Due to a magnetic field more oxygen will adsorb on the Nitinol surface and more oxygen ions will be tunneled toward the Nitinol surface through vacant and dislocation sites. It should be mentioned that simultaneously more Nickel ions will be leaving the oxide layer and entering the electrolyte due to its ferromagnetic properties. The oxide layer will become composed almost entirely of titanium dioxide [$TiO_2$]. The highest oxygen concentration will lead to a higher extent of saturation and bridge lattice defects making the passive film more homogeneous and elastic with increased fatigue resistance.

SUMMARY OF THE INVENTION

The present invention is a method to increase the elasticity and fatigue fracture resistance of Nitinol [NiTi] by filling out oxygen vacancies by increasing the depth of the oxide layer, bridging surface defects, and significantly decreasing the Nickel content in the outer passive layer of the material. This may be accomplished by utilizing an electropolishing process, or a magnetoelectropolishing process, where both processes are carried out under an Oxygen evolution regime for increasing Oxygen adsorption of the material during the process. The change in Nitinol properties may also be accomplished by utilizing an anodizing process, or a magnetanodizing process, where both processes are, likewise, carried out under an Oxygen evolution regime for increasing Oxygen adsorption of the material during the process.

Oxygen adsorption causes an Oxygen saturation, enrichment, and oxygen vacancy reduction through the depth of passive layer of the material, as well as the bridging of the surface oxide lattice defects. The resulting Nitinol material will exhibit a more homogeneous, stoichiometric, protective layer as well as under layers having an increased oxygen content such that the material properties are changed resulting in greater elasticity and fatigue fracture resistance for superior use of the Nitinol material in implanted devices, arthroscopic tools, and other devices used for medical or dental purposes on or in the human body.

The process for enhanced cyclic fatigue resistance in Nitinol intermetallic materials may be described as using an electrolytic cell having an anodic workpiece, a cathode, a container for initiating and maintaining the dissolution of the material containing Nitinol in an electrolytic solution maintained at a selected temperature for a predetermined period of time. The process is to be maintained under oxygen evolution ($O_2\uparrow$) with oxygen generated through the process being adsorbed into the outer surface layers of the Nitinol material filling any oxide lattice defects through the depth of the oxide layer and eliminating inclusion sites and other micro-fractures at or near the surface by dissolving unwanted minute surface particles and bridging the inclusion sites and other micro-fractures in the surface layer of the Nitinol material resulting in improved cyclic fatigue resistance by the elimination of the inclusion sites and other micro-fractures resulting in the strengthening of the surface layers of the Nitinol material and producing greater stoichiometric homogeneity of the Nitinol material.

The foregoing process can also be utilized with an externally applied magnetic force from one or more magnets that extend entirely around and circumscribe the electrolytic cell establishing a uniform magnetic field within sufficient to surround and encompass the cathode and the anodic workpiece for magnetoelectropolishing or magnetoanodizing the Nitinol material work piece under oxygen evolution regime ($O_2\uparrow$). The process can be selected from the group consisting of processes for electropolishing, anodizing, and appropriate combinations thereof. The process can also be selected from the group consisting of electropolishing, magnetoelectropolishing, anodizing, magnetoanodizing, and appropriate corn binations thereof.

The process of electropolishing and magnetoelectropolishing under oxygen evolution regime ($O_2\uparrow$) can also be utilized for a ternary nitinol intermetallic material or for anodizing and magnetoanodizing a chemically etched and mechanically polished ternary nitinol intermetallic material also under oxygen evolution regime ($O_2\uparrow$). If a ternary element is combined with the Nitinol material the ternary element can be selected from the group consisting of Au, Cr, Cu, Fe, Hf, Pd, Pt, Ta, and Zr.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description.

Electropolishing, also known as electrochemical polishing or electrolytic polishing (especially in the metallography field), is an electrochemical process that removes material from a metallic workpiece. It is used to polish, passivate, and deburr metal parts. It is often described as the reverse of electroplating. It may be used in lieu of abrasive fine polishing in microstructural preparation. In an electropolishing process, typically, the workpiece is immersed in a temperature-controlled bath of electrolyte and serves as the anode; it is connected to the positive terminal of a DC power supply, the negative terminal being attached to the cathode. A current passes from the anode, where metal on the surface is oxidized and dissolved in the electrolyte, and transported to the cathode. At the cathode, a reduction reaction occurs, which normally produces hydrogen.

Electrolytes used for electropolishing are most often concentrated acid solutions having a high viscosity, such as mixtures of sulfuric acid and phosphoric acid. Other electropolishing electrolytes reported in the literature include mixtures of perchlorates with acetic anhydride and methanolic solutions of sulfuric acid. To achieve electropolishing of a rough surface, the protruding highpoints of a surface profile must dissolve faster than the recesses. This process, referred to as anodic leveling, is achieved by a mass transport limited dissolution reaction. Anodic dissolution under electropolishing conditions that will deburr metal objects due to increased current density on corners and burrs.

Electropolishing of Nitinol is performed in an electrolytic cell holding a known quantity of electrolyte. The Nitinol material is attached in the cell as the anode and is suspended in the cell a predetermined distance beneath the surface of the electrolyte. The cathode for the process consists of a 316L stainless steel screen which is positioned around the internal wall of the cell. The process is performed under a constant potential of 10 volts at an ambient temperature of approximately 25° C. for a predetermined period of time under an Oxygen evolution regime. Oxygen evolution is the process of generating molecular oxygen by or through a chemical reaction. Mechanisms of oxygen evolution include the oxidation of water during oxygenic photosynthesis, electrolysis of water into oxygen and hydrogen, and electrocatalytic oxygen evolution from oxides and oxoacids. Oxygen generated by the process is adsorbed into the outer surface layers of the Nitinol as described herein. Following conclusion of the immersion electropolishing process, the Nitinol is ultrasonically cleaned in distilled water.

Magnetoelectropolishing is performed exactly as in an electropolishing process with the addition of an externally applied constant magnetic field of approximately 100 mT. The external magnetic field is imposed on the electropolishing system by placing the electrolytic cell within a series of stacked ring magnets that interact together. The application of the constant magnetic field has the effect of substantially depleting all ferromagnetic Nickel from the surface passive layer of Nitinol resulting in the layer being almost totally consisting of Titanium Dioxide [$TiO_2$] upon the termination of the magnetoelectropolishing process.

Like electropolishing, anodizing is an electrolytic passivation process used to increase the thickness of the natural oxide layer on the surface of metal materials to form a protective coating for the material. The process is called anodizing because the metal to be treated forms the anode electrode of an electrical circuit. Anodizing increases corrosion resistance and wear resistance. Anodization changes the microscopic texture of the surface and changes the crystal structure of the metal near the surface of the material. Thick coatings are normally porous, so a sealing process is often needed to achieve corrosion resistance. Anodized aluminum surfaces, for example, are harder than aluminum but have low to moderate wear resistance that can be improved with increasing thickness or by applying suitable sealing substances. Anodic films are generally much stronger and more adherent than most types of paint and metal plating, but also more brittle. This makes them less likely to crack and peel from aging and wear, but more susceptible to cracking from thermal stress. An anodized oxide layer typically has a thickness in the range of 30 nanometers ($1.2\times10^{-6}$ in.) to several micrometers.

Typically the anodizing of titanium is used to generate an array of different colors without dyes, with the anodized titanium sometimes used in art, costume jewelry, body piercing jewelry and wedding rings. The resulting color of the anodized metal is dependent on the thickness of the oxide (which is determined by the anodizing voltage); and is caused by the interference of light reflecting off the oxide surface with light traveling through it and reflecting off the underlying metal surface. Standards for titanium anodizing are given by AMS 2487 and AMS 2488.

One example of anodization is presented using aluminum. The anodized aluminum layer is grown by passing a direct current through an electrolytic solution, with the aluminum object serving as the anode (the positive electrode). The current releases hydrogen at the cathode (the negative electrode) and oxygen at the surface of the aluminum anode, creating a build-up of aluminum oxide. Alternating current and pulsed current is also possible but rarely used. The voltage required by various solutions may range from 1 to 300 V DC, although most fall in the range of 15 to 21 V DC. Higher voltages are typically required for thicker coatings formed in sulfuric and organic acid. The anodizing current varies with the area of aluminum being anodized, and typically ranges from 30 to 300 amperes/meter$^2$ (2.8 to 28 amperes/ft$^2$). Conditions such as electrolyte concentration, acidity, solution temperature, and current must be controlled to allow the formation of a consistent oxide layer. Harder, thicker films tend to be produced by more dilute solutions at lower temperatures with higher voltages and currents. The film thickness can range from under 0.5 micrometers for bright decorative work up to 150 micrometers for architectural applications.

Like electropolishing, anodizing Nitinol is performed in an electrolytic cell holding a known quantity of electrolyte. The Nitinol material is attached in the cell as the anode and is suspended in the cell a predetermined distance beneath the surface of the electrolyte. The cathode for the process consists of a non-reactant metal that will conduct electricity which is positioned along the internal wall of the cell. During Magnetoanodizing the magnetic field is imposed on the anodizing system by placing the electrolytic cell within a series of stacked ring magnets that interact together. The application of the constant magnetic field has the effect of substantially depleting all ferromagnetic Nickel from the surface passive layer of Nitinol resulting in the layer being almost totally consisting of Titanium Dioxide [$TiO_2$] upon the termination of the magnetoelectropolishing process.

In all four of the processes described above, free Oxygen [$O_2$] is generated and adsorbed by the surface and subsurface layers of the Nitinol material. The adsorbed oxygen fills any oxide lattice defects through the depth of the oxide layer and bridges defects on most of the outer oxide surface layer creating a more stoichiometric condition and homogeneity in the passive oxide film layer of the material. This Oxygen enrichment process does not alter the thickness of the outer protective oxide layer but does result in the improved fatigue resistance of the material by the elimination of inclusion sites and other micro-fractures at or near the surface of the Nitinol material. This phenomenon also greatly improves the material elasticity which works to retard crack initiation through continued stretching, shrinking and contorting of the Nitinol material when used.

Examples:

A series of groups of Nitinol suture passer needles, used in mini-invasive arthroscopic surgeries, each underwent three different electrochemical treatments:

1. Magnetoelectropolishing in proprietary electrolyte under oxygen evolution regime ($O_2\uparrow$);
2. Anodizing of magnetoelectropolished needles under oxygen evolution regime ($O_2\uparrow$) in proprietary electrolyte; and,
3. Standard electropolishing in methanol-sulfuric acid electrolyte below oxygen evolution regime.

Each group of different electrochemically treated needles consisted of 5 pieces (n=5). The Needles which underwent the different electrochemical treatments, as listed above, were cyclic fatigue tested against needles in an "as received condition" that were manufactured with an EDM—cut, with blue post heat treatment color. The tested needles were EDM—cut from the same piece of Nitinol sheet material and had the following dimensions: length—59 mm, width—1.45 mm, and thickness—0.27 mm. The needles were cyclic fatigue tested using a Mark 10 ESM 301 tester with custom made fixture with speed of 178 mm/minute. During one complete testing cycle a needle underwent two continuous bends: first bend approximating 90°, second bend approximating 70°. The needles were continually tested until fracture occurrence. The results of the test are tabularized below.

TABLE 1

| Specimen | Test 1 | Test 2 | Test 3 | Test 4 | Test 5 | AVG | STDEV | AVG-3Sigma |
|---|---|---|---|---|---|---|---|---|
| Standard, baseline needle (as received with blue post heat treatment color) | 30 | 31 | 32 | 28 | 29 | 30 | 1.4 | 25.8 |
| Magnetoelectropolished ($O_2\uparrow$) | 220 | 97 | 179 | 109 | 111 | 143 | 48.0 | −0.8 |
| Magnetoelectropolished ($O_2\uparrow$) + Anodize ($O_2\uparrow$) | 147 | 150 | 161 | 174 | 142 | 155 | 11.4 | 120.5 |
| Standard electropolishing (below oxygen evolution regime) | 37 | 29 | 47 | 36 | 52 | 40 | 8.2 | 15.5 |

As can be seen from the Table, the highest cyclic fatigue improvement was achieved by using two consecutive electrochemical treatments namely magnetoelectropolishing followed by anodizing, with both processes performed under oxygen evolution regime ($O_2\uparrow$). It is also noted that consecutive treatments (magnetoelectropolishing+anodizing) offers not only an increased average cycle life until fracture, but also a lower standard deviation of 11.4 between tested devices.

The magnetoelectropolished samples have a very similar average cycle until fracture, however they also possess a larger standard deviation of 48 between treated samples. As can also be seen from Table 1, the use of the most commonly applied Nitinol electropolishing process below oxygen evolution regime gives the lowest improvement in cyclic fatigue of 40 cycles until fracture, which translates to ¼ fold improvement of fatigue resistance compared with fatigue resistance of "as received" needles. Moreover, magnetoelectropolished and magnetoelectropolished+anodized treatments produce a cyclic fatigue resistance improvement of the Nitinol material devices to increase compared to "as received" tested sample needles.

The foregoing examples and testing provide the insight to conclude that the combination of the several processes, i.e., electropolishing, magnetoelectropolishing, anodizing and magnetoanodizing, in appropriate process combinations, will result in a much longer lasting Nitinol material that retains enhanced fracture fatigue resistance and a much enhanced stoichiometric homogeneity in its surface layers producing a much better product for use in the human body that will not leach dissolved metallic ions through the strengthened surface layers or fracture due to cyclic bending. Thus, a much safer Nitinol product can be achieved utilizing the teachings of the appropriate combination of the foregoing processes.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A process for enhanced cyclic fatigue resistance in Nitinol intermetallic materials, the process comprising:

using an electrolytic cell having a Nitinol intermetallic material anodic workpiece, a cathode, and a container for retaining an electrolytic solution maintained at a selected temperature for a predetermined period of time, establishing a uniform magnetic field within the electrolytic cell sufficient to surround and encompass the cathode and the Nitinol intermetallic material anodic workpiece using an externally applied magnetic force from one or more magnets extending entirely around and circumscribing the electrolytic cell for magneto-anodizing the Nitinol intermetallic material anodic workpiece, and said process being maintained under oxygen evolution ($O_2\uparrow$) with oxygen generated through said process being adsorbed into the outer surface layers of the Nitinol intermetallic material filling any oxide lattice defects through the depth of the oxide layer and eliminating inclusion sites and other micro-fractures at or near the surface by dissolving unwanted minute surface particles and bridging said inclusion sites and other micro-fractures in the surface layer of the Nitinol intermetallic material resulting in improved cyclic fatigue resistance by the elimination of said inclusion sites and other micro-fractures strengthening the surface layers of the Nitinol intermetallic material to produce greater stoichiometric homogeneity of the Nitinol intermetallic material.

2. The process according to claim 1 wherein prior to the magnetoanodizing process the Nitinol intermetallic material anodic workpiece is chemically etched and mechanically polished.

3. The process according to claim 1 wherein the Nitinol intermetallic material anodic workpiece is a ternary Nitinol intermetallic material, the ternary element is selected from the group consisting of Au, Cr, Cu, Fe, Hf, Pd, Pt, Ta, and Zr.

* * * * *